US005093689A

United States Patent [19]

Imaeda

[11] Patent Number: 5,093,689

[45] Date of Patent: Mar. 3, 1992

[54] IMAGE FORMING APPARATUS AND METHOD USING INTERMEDIATE SUPPORTING MEDIUM HAVING THERMAL ADHESIVE

[75] Inventor: Mikio Imaeda, Bisai, Japan

[73] Assignee: Brother Kogyo Kabushiki Kaisha, Aichi, Japan

[21] Appl. No.: 643,284

[22] Filed: Jan. 22, 1991

[30] Foreign Application Priority Data

Jan. 23, 1990 [JP] Japan ..... 2-14523
Jan. 29, 1990 [JP] Japan ..... 2-18173

[51] Int. Cl.[5] ..... G03G 15/12

[52] U.S. Cl. ..... 355/279; 355/280; 430/126

[58] Field of Search ..... 355/278, 279, 280, 281, 355/290, 211, 212, 213; 430/126, 47, 66

[56] References Cited

U.S. PATENT DOCUMENTS 3,838,919 10/1974 Takahashi ..... 430/47 X
4,863,543 9/1989 Shiozawa et al. ..... 430/126 X

FOREIGN PATENT DOCUMENTS 0276153 11/1989 Japan ..... 355/290

*Primary Examiner*—A. T. Grimley
*Assistant Examiner*—P. J. Stanzione
*Attorney, Agent, or Firm*—Oliff & Berridge

[57] ABSTRACT

Image forming apparatus and method for forming a visible image on an image recording medium using a photosensitive medium having a substrate and a photosensitive image forming layer thereon and an intermediate supporting medium having a support member and a thermal adhesive layer thereon, comprising an electrophotographic unit for electrophotographically forming a latent image on the photosensitive image forming layer and developing the latent image into a visible image, a first image transferring unit for transferring the photosensitive image forming layer having the visible image thereon from the photosensitive medium to the intermediate supporting medium with heat and pressure, and a second image transferring unit for transferring the photosensitive image forming layer having the visible image thereon from the intermediate supporting medium to an image recording medium under heat and pressure.

17 Claims, 3 Drawing Sheets

IMAGE FORMING APPARATUS AND METHOD USING INTERMEDIATE SUPPORTING MEDIUM HAVING THERMAL ADHESIVE

BACKGROUND OF THE INVENTION

This invention relates to image forming apparatus and method capable of forming an image on a plain paper.

There has been well known an electrofax method for forming a visible image using a photosensitive sheet comprising a conductive substrate and a photoconductive layer thereon. In this method, the photosensitive sheet is precharged and selectively exposed to light to form an electrostatic latent image, and thereafter the latent image is developed into the visible image using liquid developer agent which is formed by dispersing toner particles in insulating medium. Further, there has been proposed an image forming apparatus for forming a full color image on the above photosensitive sheet by successively carrying out the above method for three colors such as yellow, magenta and cyan.

In the conventional apparatus as described above, a high quality image can be easily obtained because no toner transfer process is needed. However, a visible image is formed only on a specifically manufactured sheet, that is, it is impossible to form an image on an image recording medium other than the specifically-manufactured sheet.

SUMMARY OF THE INVENTION an object of this invention is to provide image forming apparatus and method capable of forming a visible image on an image recording medium such as a post card, a copy sheet, letter paper or the like.

In order to attain the above object, according to one aspect of this invention, an image forming apparatus according to this invention includes a photosensitive medium comprising a substrate and a photosensitive image forming layer thereon, an electrophotographic unit for electrophotographically forming a latent image on the photosensitive image forming layer and developing the latent image into a visible image, an intermediate supporting medium having a support member and a thermal adhesive layer thereon for receiving the visible image formed on the photosensitive medium through the adhesive layer and temporally supporting the visible image thereon, the thermal adhesive layer developing an adhesive capability with heat, a first image transferring unit for transferring the photosensitive image forming layer having the visible image thereon from the photosensitive medium to the intermediate supporting medium through a first heat and pressure operation of the thermal adhesive layer, and a second image transferring unit for transferring the photosensitive image forming layer having the visible image thereon from the intermediate supporting medium to the an image recording medium through a second heat and pressure operation of the thermal adhesive layer.

According to another aspect of this invention, an image forming method according to this invention comprises the steps of, electrophotographically forming a latent image on the photosensitive image forming layer, and developing the latent image into the visible image with toners, superposing the photosensitive medium over an intermediate supporting medium having a support member and a thermal adhesive layer thereon under heat and pressure to thereby unify the photosensitive medium and the intermediate supporting medium through the thermal adhesive layer, separating the photosensitive medium from the intermediate supporting medium while leaving the photosensitive image forming layer having the visible image on the intermediate supporting medium, superposing the intermediate supporting layer having the visible image thereon over the any image recording medium under heat and pressure to thereby unify the intermediate supporting medium and the any image recording medium through the thermal adhesive layer, and separating the intermediate supporting medium from the any image recording medium while leaving the photosensitive image forming layer having the visible image on the an image recording medium.

DETAILED DESCRIPTION OF THE INVENTION

Preferred embodiments according to this invention will be described hereunder with reference to the accompanying drawings.

Figure 1:
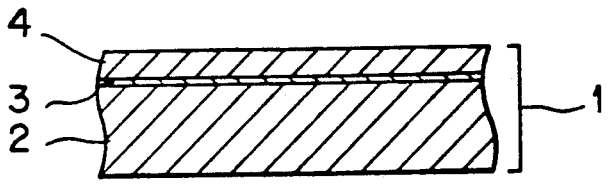
FIG. 1 is a cross-sectional view of a photosensitive sheet used in the image forming apparatus according to this invention.

FIG.1 shows a photosensitive sheet 1 which is used as an image forming medium in the image forming apparatus of this invention. The photosensitive sheet 1 comprises a substrate 2, a conductive layer 3 and a photoconductive layer 4 serving as an image supporting layer, which are laminated in this order.

The substrate 2 of the photosensitive sheet 1 is preferably formed of a resin film having a sufficient surface smoothness such as polyethylene terephthalate film, polyethylene film, nylon film, polycarbonate film or the like. The conductive layer 3 generally comprises an Al deposition layer, however, other metal deposition layers than Al may be used as the conductive layer 3 as occasion demands. A conductive sheet, which has been subjected to a treatment for increasing its conductivity using salt of quaternary ammonium or the like may be singly used in place of the combination of the substrate 2 and the conductive layer 3, but the resin film is more preferable because it can obtain a higher quality image than the conductive sheet.

The photoconductive layer 4 may be formed of a resin binder in which photoconductive fine particles of white or light color such as zinc oxide or titanium oxide are dispersed together with various sensitizers.

Figure 2:
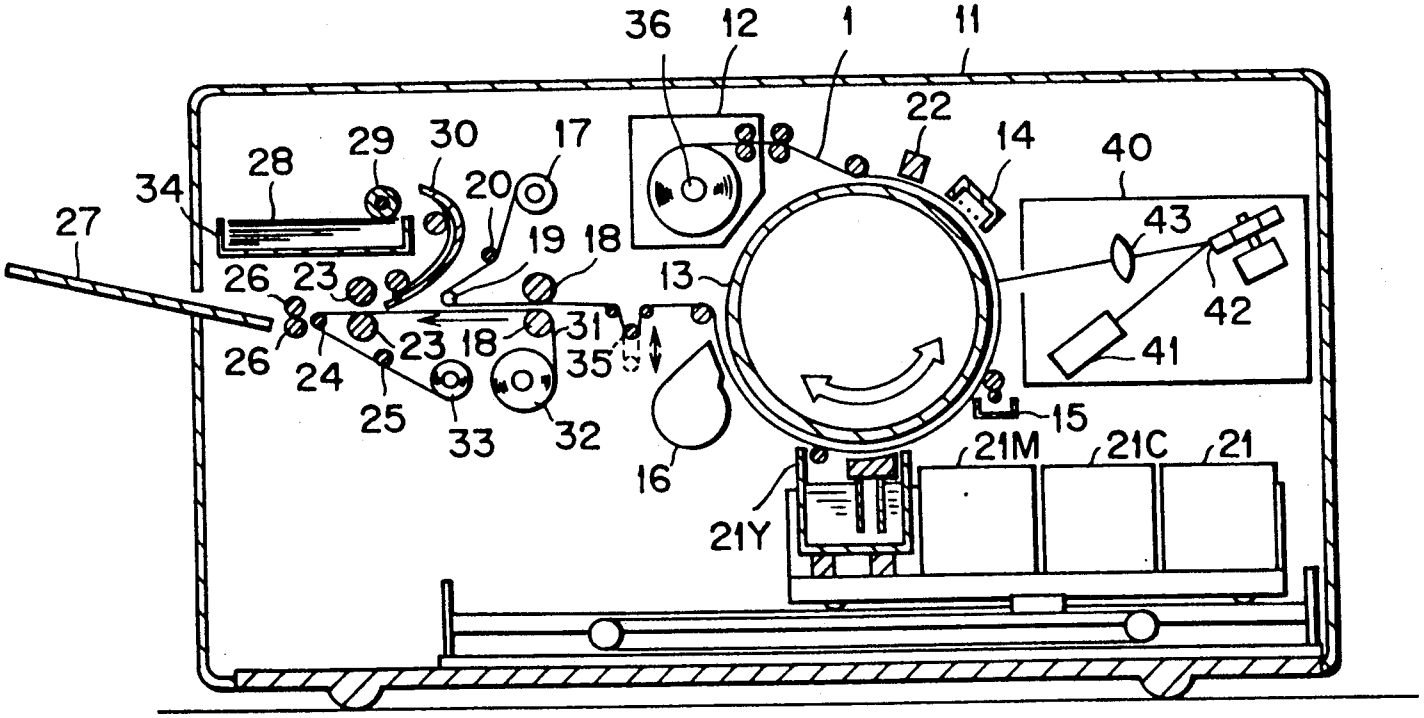
FIG. 2 shows a first embodiment of the image forming apparatus according to this invention.

FIG. 2 shows a first embodiment of an image forming apparatus according to this invention.

The image forming apparatus 11 includes a sheet case 12 for accommodating a rolled photosensitive sheet 1, a stage drum 13 provided at the right hand lower side of the sheet case 12 and various image forming units disposed so as to surround the stage drum 13, such as a discharging lamp 22, a scotron 14, a prewet device 15, a laser exposure unit 40, wet type developing units 21Y, 21M, 21C, 21B for yellow, magenta, cyan and black colors, respectively, and a dryer 16. The photosensitive sheet 1 is drawn out of the sheet case 12, and fed along the peripheral surface of the stage drum 13 to a take-up roller 17. The laser exposure unit 40 comprises a laser source 41 for emitting a laser beam, a polygon mirror 42 for scanning the laser beam and a lens 43 for focusing the laser beam to the photosensitive sheet 1 traveling around the stage drum 13. At the left side of the stage drum 13, a pair of first heat rollers 18 are provided so as to nip the photosensitive sheet 1 and an intermediate support medium as shown in FIG. 3.

Figure 3:
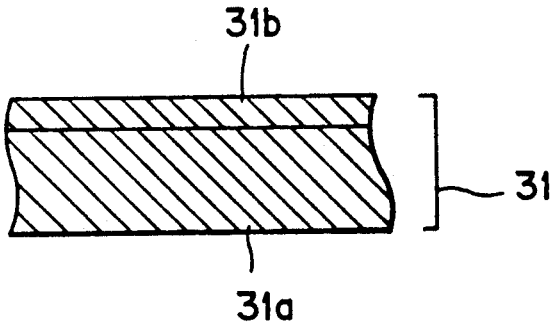
FIG. 3 is a cross-sectional view of an intermediate supporting medium used in the image forming apparatus as shown in FIG. 2.

As shown in FIG. 3, the intermediate support medium 31 comprises a substrate 31*a* having sufficient surface smoothness and a thermal adhesive layer such as thermoplastic resin layer 31*b* on the substrate 31*a*. The substrate 31*a* of the intermediate support medium 31 is preferably formed of polyethylene terephthalate film, polycarbonate film, nylon film, polyphenylene sulfide or the like, and the thermoplastic resin layer is preferably formed of vinyl resin such as vinyl alcohol/vinyl acetate copolymer, vinyl alkyl ether/maleic anhydride copolymer, polyvinyl chloride or vinyl chloride/vinyl acetate copolymer, acrylic resin such as poly(ethyl acrylate), poly(butyl methacrylate), or poly(methyl cyanoacrylate), styrene resin, or polyamide resin. As occasion demands, wax may be added to the thermoplastic resin layer. At the lower side of the first heat rollers 18, an intermediate support medium supply roll 32 is provided to supply the intermediate support medium 31 to a gap between the first heat rollers 18. The intermediate support medium 31 is fed through the gap in synchronism with the movement of the photosensitive sheet 1 while superposed over the photosensitive sheet 1 in the gap, and then wound up by a take-up roller 33.

At the downstream side of the first heat rollers 18 with respect to a sheet feed path, a first separation roller 19 is provided to separate the superposed photosensitive sheet 1 and the intermediate support medium 31, and along the sheet feed path two tension rollers 20 and 35 are provided to keep the traveling photosensitive sheet 1 at a constant tension. Further, The take-up roller 17 for winding up the used photosensitive sheet 1 is provided at the upper side of the heat rollers 18, and second heat rollers 23 are provided at the left side of the first separation roller 19. At the left side of the second heat rollers 23, a second separation roller 24 is provided. Further, another tension roller 25 is provided to keep the intermediate support medium 31 at a constant tension.

On the other hand, a sheet cassette 34 for accommodating a stack of an image recording medium, for example, plain paper 28 is provided at the upper side of the second heating rollers 23, and a sector roller 29 for picking up the stack of the plain paper one by one from the sheet cassette 34 and a guide 30 for guiding the plain paper picked up by the sector roller 29 to the second heat rollers 23 are provided at the upper side of the sheet cassette 34.

An image forming process of the image forming apparatus as shown in FIG. 1 will be described hereunder.

The photosensitive sheet 1 is suspended between a sheet supply roller 36 of the sheet case 12 and the take-up roller 17, and is kept at a constant tension under tension force by the tension rollers 20 and 35. At an initial stage of the image forming process, the tension roller 35 is moved downwardly, and in synchronism with the movement of the tension roller 35 the photosensitive sheet 1 is drawn out of the sheet case 12. The photosensitive sheet 1 is uniformly charged by the scotron 14, and then is subjected to an exposure process.

The exposure process is carried out by the well known laser exposure unit 40 for irradiating an original image light to the photosensitive sheet 1. In the exposure process, a laser beam which is irradiated from the laser source 41 while modulated by an original image signal, is scanned by the polygon mirror 42 and focused on the photosensitive sheet 1 through the lens 43 to form an electrostatic latent image on the photosensitive sheet 1. In this embodiment, it is assumed that a latent image for yellow image (hereinafter referred to as "yellow latent image") is first formed on the photosensitive sheet 1 through the first exposure process.

The photosensitive sheet 1 having the yellow latent image thereon is subjected to a filling treatment by the prewet unit 15. The filling treatment is adopted to fill fine recesses on the surface of the photosensitive sheet 1 with a filling agent which is used as a solvent for the liquid developing agent. After the filling treatment, the photosensitive sheet 1 is subjected to a wet development by the wet type developing unit 21Y, so that the yellow latent image is developed into a yellow visible image on the photosensitive sheet 1.

After the above processes have been completed, the sheet supply roller 36, the tension roller 35 and the stage drum 13 are reversely rotated, and the tension roller 35 is upwardly moved to thereby return the photosensitive sheet 1 toward the sheet case 12 until the leading end of the yellow visible image on the photosensitive sheet 1 is positioned at the discharging lamp 22. Thereafter, the tension roller 35, the sheet supply roller 36 and the stage drum 13 are forwardly rotated to feed the photosensitive sheet 1 to the downstream of the sheet feed path while the discharging lamp 22 supplies the photosensitive sheet 1 with light in such a amount that surplus charges remaining on the photosensitive sheet 1 are removed, whereby the photosensitive sheet 1 is returned to an initial state.

The above electrophotographic processes such as the uniform charging process, the selective exposure process for forming a latent image and the developing process for developing the latent image are carried out to form a magenta visible image, so that the yellow and magenta visible images are finally formed on the photosensitive sheet 1.

The photosensitive sheet 1 having the yellow and magenta visible images are rewound again, and then the above processes are repeated for forming cyan and black images to form a full color image. The manner of obtaining a full color image is not limited to the above order of the processes, and any modification may be adopted as occasion demands.

Thereafter, the photosensitive sheet 1 having the full color image thereon is supplied with warm air by the dryer 16 to vaporize the solvent remaining on the photosensitive sheet 1, and then is fed to the gap between the first heat rollers 18.

The photosensitive sheet 1 having the full color image is superposed over the intermediate support medium 31 which is drawn out of the intermediate support medium supply roll 32, and these superposed sheet 1 and medium 31 are supplied with pressure and heat through the gap between the first heat rollers 18 to melt the thermoplastic resin layer 31*b* of the intermediate support medium 31 and unify the photosensitive sheet 1 and the intermediate support medium 31. After the melt thermoplastic resin 31*b* is cooled and solidified, the unified intermediate support medium 31 and the photosensitive sheet 1 are subjected to a separation process by the first separation roller 19, In this separation process, exfoliation between the photoconductive layer 4 and the conductive layer 3 occurs, and thus the photosensitive sheet 1 is exfoliated from the intermediate support medium 31 while leaving the photoconductive layer 4 having the full color image on the intermediate support medium 31. The thus exfoliated intermediate support medium 31 supporting the full color image thereon is further fed to the downstream side of the sheet feed path. On the other hand, the exfoliated substrate 2 and the conductive layer 3 of photosensitive sheet 1 are wound up by the take-up roller 17 while kept at a constant tension by the tension roller 20.

According to the movement of the intermediate support medium 31 supporting the full color image thereon, the plain paper 28 accommodated in the sheet cassette 34 is picked up by the sector roller 29, and guided along the guide 30 to a gap between the second heat rollers 23. In the gap between the second heat rollers 23, the plain paper 28 and the intermediate support medium 31 are superposed over each other under pressure and heat, so that the thermoplastic resin layer 31*b* is again melted to unify the intermediate support medium 31 and the plain paper 28.

During an exfoliating process for exfoliating the intermediate support medium 31 (the substrate 31*a*) from the unified donor film 31 and the plain paper 28 by the second separation roller 24, exfoliation between the photoconductive layer 4 having the full color image and the substrate 31*a* occurs and thus the intermediate support medium 31 is separated from the plain paper 28 while leaving the photoconductive layer 4 having the full color image on the plain paper 28, whereby the full color image is finally supported on the plain paper 28. The exfoliated intermediate support medium 31 is wound up by the take-up roller 33, while the plain paper 28 having the full color image thereon is discharged through a gap between discharging rollers 26 to a discharge tray 27.

Figure 4:
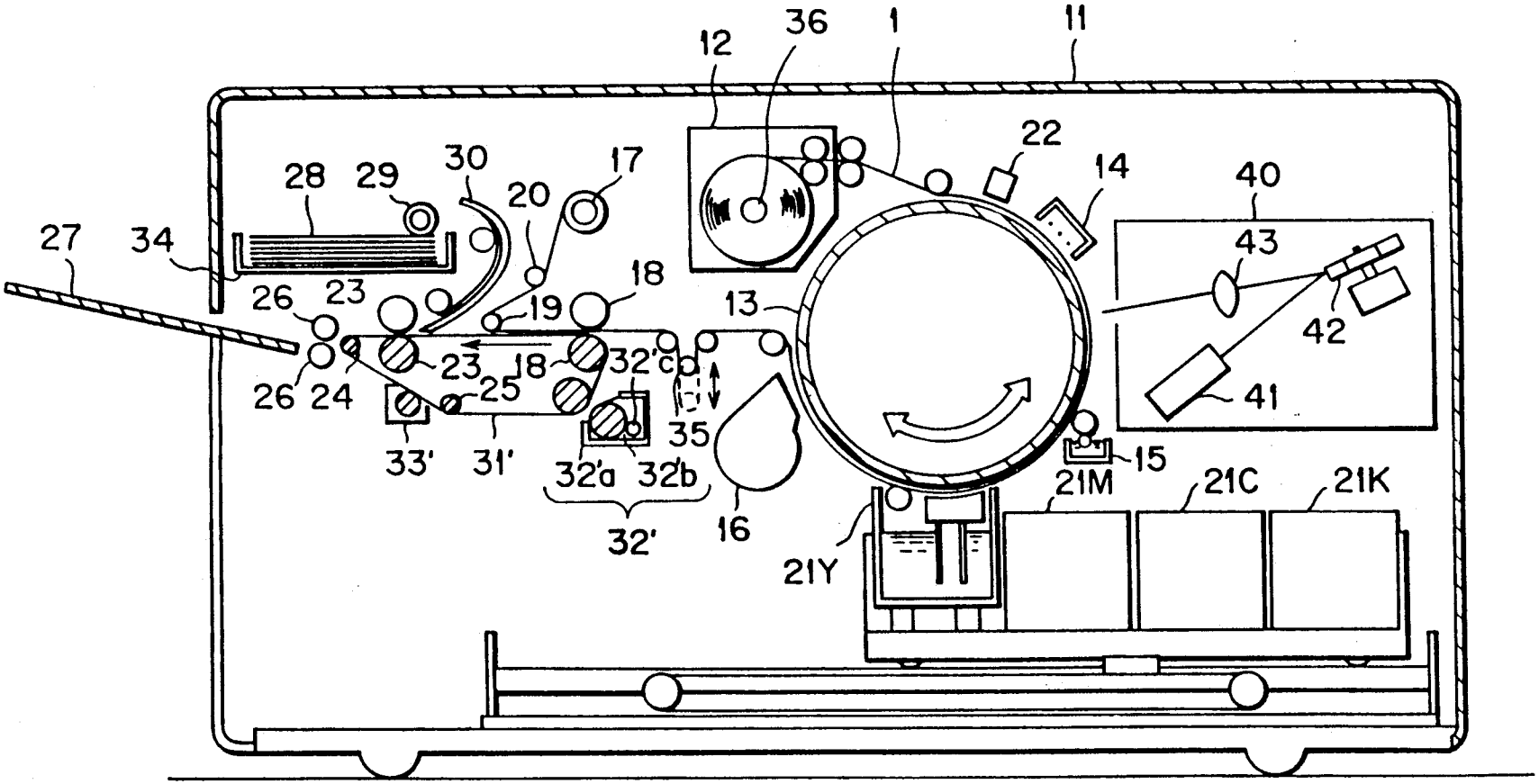
FIG. 4 shows a second embodiment of the image forming apparatus according to this invention.

FIG. 4 shows a second embodiment of the image forming apparatus according to this invention.

In the first embodiment, a specifically-manufactured medium which comprises a substrate and a thermoplastic resin layer thereon is required as the intermediate support medium 31, and this medium is not reused after used to transfer the visible image to the plain paper 28. However, in this embodiment, the medium can be reused for supporting the visible image from the photosensitive sheet 1 even after the visible image is transferred to the plain paper.

In the following embodiment, the same elements as those of FIG. 2 are represented by the same reference numerals and the description thereof is eliminated.

In this embodiment, an endless belt 31' is provided as an intermediate support medium, and a transparent resin toner coating unit 32' for coating resin toners to the endless belt 31' and a cleaner 33' for cleaning the endless belt 31' are further provided.

The endless belt 31' is preferably formed of resin film having high heat-resistance and sufficient surface smoothness such as polyimide film, polyphenylene sulfide film, aramid film, polyether ketone film or the like. Like the first embodiment, the endless belt 31' is kept at a constant tension by the tension roller 25.

The transparent resin toner coating unit 32 includes transparent resin toners 32*b'*, a carry roller 32*a'* for carrying the toners 32*b'* thereon and a brush roller 32*c'*, and is provided at the lower side of the heat rollers 18 to coat transparent resin toners 32*b'* to the endless belt 31' before the visible image on the photosensitive sheet 1 is fed to the gap between the heat rollers 18. The transparent resin toners 32*b'* are stirred and triboelectrically charged by rotating the brush roller 32*c'*, the charged toners 32*b'* are fed to a toner coating region in which the endless belt 31' and the carry roller 32*a'* are confronted to each other while carried on the carry roller 32*a'*, and then are electrostatically coated to the surface of the endless belt 31' by a well known method. The transparent resin toners 32' used in this embodiment are preferably formed mainly of transparent thermoplastic resin such as polystyrene, poly(methyl methacrylate), styrene/n-butyl methacrylate copolymer, polyester resin , epoxy resin or the like, and added with a charge control agent and various additives as occasion demands. The particle diameter of the particles is preferably in the range of 1 to 30 microns, and more preferably in the range of 8 to 15 microns.

An image forming process of this embodiment is substantially the same as the first embodiment, except for the difference in kind of the intermediate support medium.

The endless belt 31' coated with the transparent resin toners is superposed over the photosensitive sheet 1 in the gap between the heat rollers 18, and supplied with heat and pressure to thereby melt the transparent resin toners and unify the photosensitive sheet 1 and the endless belt 31'. After the melt toners are cooled and solidified, the unified sheet 1 and the endless belt 31' are separated from each other by the separation roller 19 while leaving the photoconductive layer having a full color image on the endless belt 31'. Like the first embodiment, the separated photosensitive sheet 1 is wound up by the take-up roller 17, while the endless belt 31' supporting the full color image is superposed over the plain paper 28 in the gap between the heat rollers 23 and supplied with heat and pressure to thereby melt the transparent resin toners again and unify the endless belt 31' and the plain paper. After the melt toners are cooled and solidified again, the endless belt 31' is exfoliated from the plain paper 28 while leaving the photoconductive layer 4 having the full color image on the plain paper 28. As a result, the full color image is finally supported on the plain paper 28 like the first embodiment.

The endless belt 31' is cleaned by the cleaner 33' to remove soil on the surface of the endless belt 31', and reused for a next image supporting process. On the other hand, the plain paper 28 supporting the full color image thereon is discharged through the discharge rollers 26 to the discharge tray 27.

In this embodiment, the transparent resin toners are electrostatically coated on the endless belt 31' to form a thermoplastic resin layer on the endless belt 31', however, the manner of forming the thermoplastic resin layer is not limited to the above manner. For example, solution or dispersion solution of the thermoplastic resin may be coated on the endless belt 31' and dried to form a thermoplastic resin layer on the endless belt 31'.

As described above, according to this embodiment, a high quality image which is obtained through the electrofax process is transferred in the form of an image recording layer, so that a full color image can be formed on an image recording medium such as post card, copy sheet, plain paper or the like without deterioration of the image quality.

What is claimed is:

1. An image forming apparatus for forming a visible image on an image recording medium, comprising:

a photosensitive medium comprising a substrate and a photosensitive image forming layer thereon;

an electrophotographic unit for electrophotographically forming a latent image on said photosensitive image forming layer and developing the latent image into a visible image;

an intermediate supporting medium having a support member and a thermal adhesive layer thereon for receiving the visible image formed on said photosensitive medium through said adhesive layer and temporarily supporting the visible image thereon, said thermal adhesive layer developing an adhesive capability with heat;

a first image transferring unit for transferring the photosensitive image forming layer having the visible image thereon from said photosensitive medium to said intermediate supporting medium through a first heat and pressure operation of said thermal adhesive layer; and a second image transferring unit for transferring the photosensitive image forming layer having the visible image thereon from said intermediate supporting medium to the any kind of medium through a second heat and pressure operation of said thermal adhesive layer.

2. The image forming apparatus as claimed in claim 1, wherein said electrophotographic unit comprises a charging unit for charging said photosensitive medium, an exposure unit for exposing said charged photosensitive medium to an original image light to form the latent image thereon and a developing unit for developing the latent image into the visible image with toners.

3. The image forming apparatus as claimed in claim 1, wherein said first image transferring unit comprises a first heat and pressure supplying unit for supplying heat and pressure to said photosensitive medium and said intermediate supporting medium while said photosensitive medium and said intermediate support medium are superposed over each other such that said photosensitive image forming layer having the visible image thereon is contacted with said thermal adhesive layer, to thereby allow said thermal adhesive layer to adhere to said intermediate supporting medium and unify said photosensitive medium and said intermediate supporting medium, and a first separation unit for separating said photosensitive medium from said intermediate supporting medium while leaving said photosensitive image forming layer having the visible image on said intermediate supporting medium, thereby temporarily supporting the visible image on said intermediate supporting medium.

4. The image forming apparatus as claimed in claim 3, wherein said second image transferring unit comprises a second heat and pressure supplying unit for supplying heat and pressure to said intermediate supporting medium and said an image recording medium while said intermediate support medium and said an image recording medium are superposed over each other such that said photosensitive image forming medium having the visible image thereon is contacted with said an image recording medium, to thereby allow said thermal adhesive layer to adhere to said an image recording medium and unifying said intermediate supporting medium and said an image recording medium, and a second separation unit for separating said intermediate supporting medium from said an image recording medium while leaving said photosensitive image forming layer having the visible image on said an image recording medium, thereby finally supporting the visible image on said an image recording medium.

5. The image forming apparatus as claimed in claim 1, wherein said thermal adhesive layer comprises a thermoplastic resin.

6. The image forming apparatus as claimed in claim 5, wherein said thermoplastic resin comprises any material selected from the group consisting of vinyl alcohol/vinyl acetate copolymer, vinyl alkyl ether/maleic anhydride copolymer, polyvinyl chloride, vinyl chloride/vinyl acetate copolymer, poly(ethyl acrylate), poly(butyl methacrylate), poly(methyl cyanoacrylate), styrene resin, polyamide resin 7. The image forming apparatus as claimed in claim 1, further comprising a coating unit for coating said support member with transparent thermoplastic resin toners to thereby form said thermoplastic resin layer on said support member.

8. The image forming apparatus as claimed in claim 7, wherein said transparent thermoplastic resin toners comprise any material selected from the group consisting of polystyrene, poly(methyl methacrylate), styrene/n-butyl methacrylate copolymer, polyester resin and epoxy resin.

9. The image forming apparatus as claimed in claim 8, wherein said transparent thermoplastic resin toners fur ther comprises a charge control agent.

10. The image forming apparatus as claimed in claim 7, wherein said thermoplastic resin toners have a particle diameter of 1 to 30 microns.

11. The image forming apparatus as claimed in claim 7, wherein said thermoplastic resin toners have a particle diameter of 8 to 15 microns.

12. The image forming apparatus as claimed in claim 7, wherein said support member comprises an endless belt having a high surface smoothness and high heat-resistance.

13. The image forming apparatus as claimed in claim 12, wherein said endless belt comprises any material selected from the group consisting of polyimide film, polyphenylene sulfide film, and aramid film, polyether ketone film.

14. The image forming apparatus as claimed in claim 1, wherein said substrate comprises any material selected from the group consisting of polyethylene terephthalate film, polyethylene film, nylon film and polycarbonate film.

15. The image forming apparatus as claimed in claim 1, wherein said conductive layer comprises an Al layer.

16. The image forming apparatus as claimed in claim 1, wherein said photoconductive layer comprises a resin binder dispersed with photoconductive fine particles of zinc oxide or titanium oxide.

17. A method of forming a visible image on an image recording medium with a photosensitive medium having a substrate and a photosensitive image forming layer thereon, comprising the steps of:

electrophotographically forming a latent image on the photosensitive image forming layer, and developing the latent image into the visible image with toners;

superposing the photosensitive medium over an intermediate supporting medium having a support member and a thermal adhesive layer thereon under heat and pressure to thereby unify the photosensitive medium and the intermediate supporting medium through the thermal adhesive layer;

separating the photosensitive medium from the intermediate supporting medium while leaving the photosensitive image forming layer having the visible image on the intermediate supporting medium;

superposing the intermediate supporting layer having the visible image thereon over an image recording medium under pressure and pressure to thereby unify the intermediate supporting medium and an image recording medium through the thermal adhesive layer; and separating the intermediate supporting medium from an image recording medium while leaving the photosensitive image forming layer having the visible image on an image recording medium.

* * * * *